US008113944B2

(12) United States Patent
Miller et al.

(10) Patent No.: US 8,113,944 B2
(45) Date of Patent: Feb. 14, 2012

(54) GAME OF CHANCE

(75) Inventors: John Miller, Seattle, WA (US); Jason York, Bellevue, WA (US); Jeffrey Blazier, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 588 days.

(21) Appl. No.: 12/268,878

(22) Filed: Nov. 11, 2008

(65) Prior Publication Data

US 2010/0120513 A1 May 13, 2010

(51) Int. Cl.
*A63F 9/24* (2006.01)

(52) U.S. Cl. ..... 463/22; 463/16

(58) Field of Classification Search ..... 463/22
See application file for complete search history.

(56) References Cited

U.S. PATENT DOCUMENTS

| | | | |
|---|---|---|---|
| 4,334,685 | A | 6/1982 | Robbins et al. |
| 5,573,248 | A | 11/1996 | Parra et al. |
| 6,302,395 | B1 | 10/2001 | Astaneha |
| 6,378,869 | B1 | 4/2002 | Hedge, Jr. et al. |
| 6,964,415 | B2 | 11/2005 | Schnitman et al. |
| 7,175,526 | B2 | 2/2007 | Moore, Jr. |
| 7,367,562 | B2 | 5/2008 | Scheb, Jr. et al. |
| 2002/0119816 | A1 | 8/2002 | Jackson |
| 2004/0155403 | A1 | 8/2004 | Carr et al. |

FOREIGN PATENT DOCUMENTS

WO 9729823 A1 8/1997

OTHER PUBLICATIONS

Kelly, Neon, "Fable 2 Pub Games Review", Dated: Aug. 13, 2008, Webpage available at :—http://www.videogamer.com/xbox360/fable_2_pub_games/review.html.

"Gambling with Your Character", Published Aug. 22, 2008, Webpage available at :—http://www.xbox.com/en-US/games/f/fable2pubgamesxboxlivearcade/20080822-preview.htm.

"Fable II Pub Games", Posted Aug. 22, 2008, Webpage available at :—http://www. gamefaqs.com/boards/genmessage.php?board=951203&topic=45038262.

"Fable II Pub Games: Keystone", Retrieved on Sep. 25, 2008, Webpage available at :— http://www.gamebanshee.com/fableii/pubgames/keystone.php.

*Primary Examiner* — Dmitry Suhol
*Assistant Examiner* — Michael Grant
(74) *Attorney, Agent, or Firm* — Alleman Hall McCoy Russell & Tuttle LLP

(57) ABSTRACT

A game of chance includes receiving a stake corresponding to a target game-item from a player. In each phase of the game, a random integer is selected and a game-item corresponding to that integer is removed from play. If the target game-item is removed from play, the player is awarded a return and the game of chance ends. If specific game-items or combinations of game items are removed from play, the player is defeated, and the game of chance ends. A subsequent phase of the game of chance begins if the player is not defeated or awarded a return.

20 Claims, 6 Drawing Sheets

GAME OF CHANCE

BACKGROUND

Many people enjoy playing games of chance. Such games can be played for fun, with nothing on the line. However, such games are often played with a player staking a bet in hopes of winning cash or another prize.

SUMMARY

A game of chance is disclosed. The game of chance may include one or more phases depending on the luck of the roll. First, a stake corresponding to a target game-item is received from a player. In each phase of the game, a random integer is selected and a game-item corresponding to that integer is removed from play. If the target game-item is removed from play, the player is awarded a return and the game of chance ends. If specific game-items or combinations of game items are removed from play, the player is defeated, and the game of chance ends. A subsequent phase of the game of chance begins if the player is not defeated or awarded a return.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
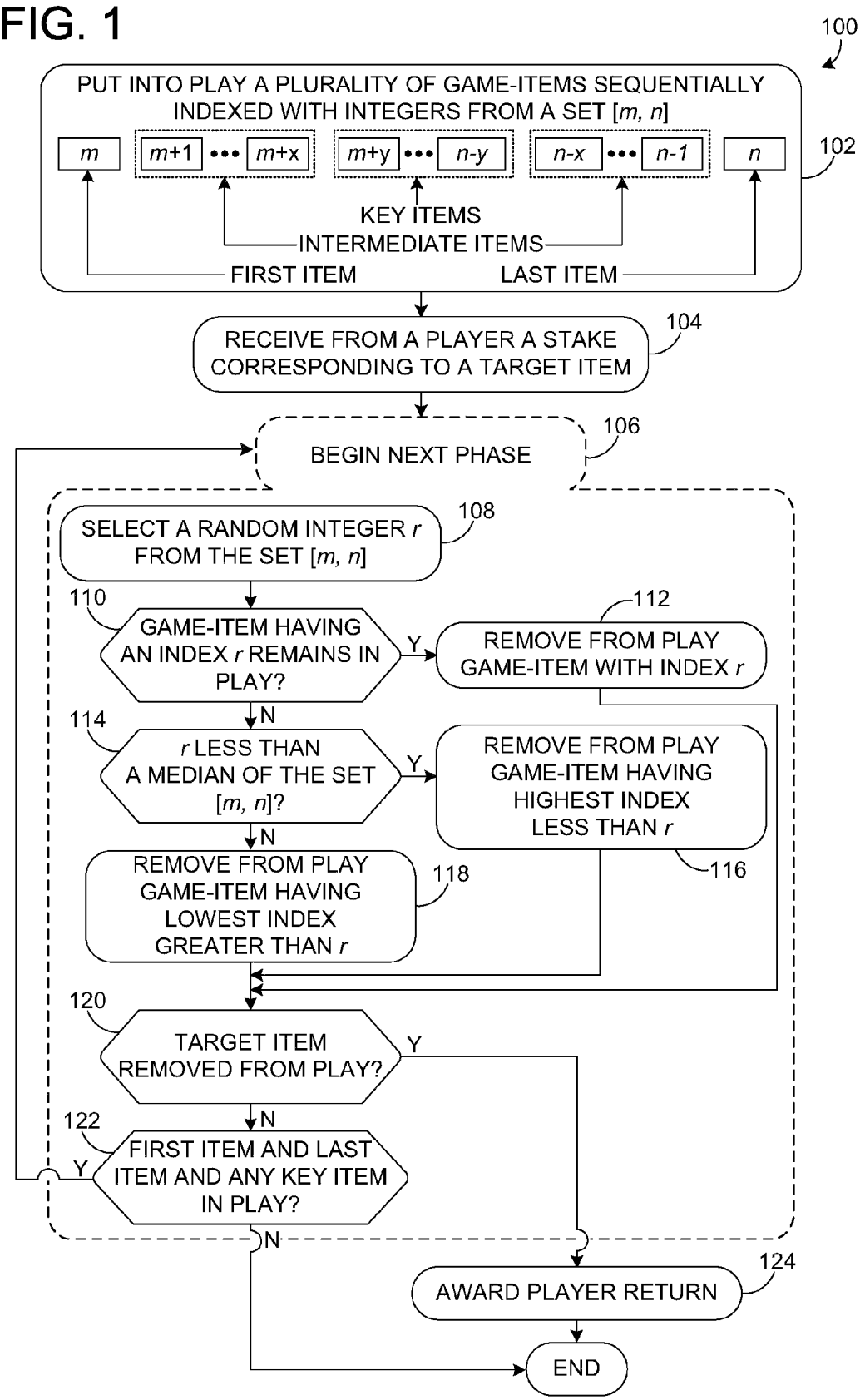
FIG. 1 shows a process flow of an example method of hosting a game of chance.

FIG. 1 shows a process flow of an example method 100 of hosting a game of chance. A game of chance can be hosted in a variety of different manners without departing from the scope of this disclosure. In some embodiments, a game of chance can be hosted as a live dice game, analogous to a live game of craps hosted at a casino. In other embodiments, a game of chance can be hosted as a video game of chance, analogous to a video-craps game in a casino. In still other embodiments, a game of chance can be hosted as a game played on a computing device, such as a personal computer, console gaming machine, portable gaming machine, personal data assistant, mobile communications device, or any other suitable computing device. When hosted on a computing device, the game of chance can be served from a remote server or executed from locally saved instructions. Further, in some embodiments, a game of chance can be a game within a game, such as a dice game that can be played by gaming characters existing in a virtual game world.

At 102, method 100 includes putting into play a plurality of game-items sequentially indexed with integers from a set [m, n]. As used herein, the bracket notation is used to indicate an inclusive list. For example, the set [3, 18] is the set 3, 4, 5, . . . , 18. As such, the plurality of game-items from the set [m, n] includes a first game-item indexed m and a last game-item indexed n, as well as any game-items having integer indexes between m and n.

For example, the plurality of game-items [m, n] may further include a set of key game-items, having indexes between m+y and n−y inclusive, equally spaced from the first game-item and the last game-item by two equally sized sets of one or more intermediate game-items. The first set of intermediate game-items [m+1, m+x] is located sequentially between the first game-item and the set of key game-items, and the second set of one or more intermediate game-items [n−x, n−1] is located sequentially between the set of key game-items and the last game-item.

In some variations, the plurality of game-items may be an even number of game-items and the set of key game-items is two game-items. In other variations, the plurality of game-items may be an odd number of game-items and the set of key game-items is one game-item. In further variations, the set of sequentially indexed game-items [m, n] may be the set of integers [3, 18], as shown in FIGS. 2A-4C. In this example, the key game items are indexed 10 and 11. It is to be understood that virtually any number of game-items and/or key game-items may be used without departing from the scope of this disclosure.

A game of chance can be played with a variety of different game-items. For example, a full set of game-items may be a set of physical or virtual stones. As another example, the game-items may be a collection of physical or virtual tiles. As yet another example, the game-items may be data stored in computer memory.

At 104, method 100 includes receiving a stake from a player corresponding to a target game-item. In some embodiments, the player may be one of a plurality of players and a stake corresponding to a target game-item is received from each of the plurality of players.

Figure 2A:
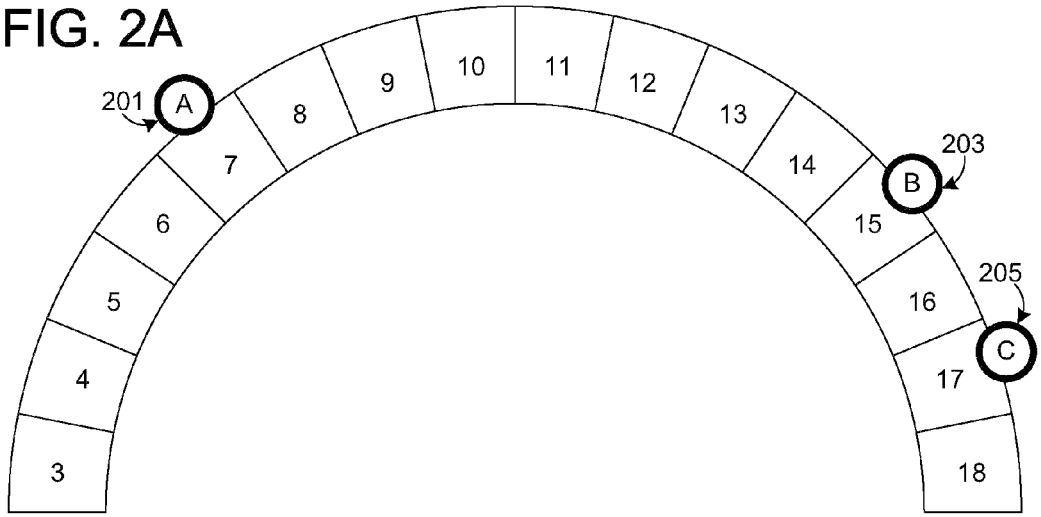
FIGS. 2A-2E show an example sequence of phases of a game of chance.

FIG. 2A shows an example arrangement in which stakes corresponding to target game-items are received from three players (e.g., player A, player B, and player C). In FIG. 2A, game-items indexed 3 through 18 are arranged in an arch. In the illustrated scenario, player A stakes a wager on a target item having an index of 7 (e.g., game-item 7) as indicated at 201, player B stakes a wager on a target item having an index of 15 (e.g., game-item 15) as indicated at 203, and player C stakes a wager on a target item having an index of 17 (e.g., game-item 17) as indicated at 205. In some embodiments, a player may stake wagers on a plurality of game-items.

The stake may take a variety of different forms depending on the manner in which the game of chance is being hosted. In a casino dice game, the stake may take the form of a cash or cash equivalent (e.g., chips) wager. In a video-game, the stake may be a submission of one or more virtual dollars or points, which may or may not correspond to cash or other value outside of the game. In some embodiments, the initial stake may simply be acceptance by a player to play the game. As explained in more detail below, a particular amount (e.g., 10 dollars or points) may be set as a base stake, and the amount of any return (i.e., winnings) is proportional to the actual stake wagered by a player. For example, winnings from a 10 dollar or 10 point stake are twice as big as winnings from a 5 dollar or 5 point stake. Turning back to FIG. 1, at 106, method 100 includes beginning the next phase of the game of chance. As described in detail below, the number of phases in a given game of chance can vary depending on the luck of the roll.

When one phase ends, subsequent phases may be iteratively begun, so that each new phase follows an immediately previous phase.

As shown at 108 of method 100, each new phase begins with selecting a random integer r from the set [m, n]. In some embodiments, random integers may be selected such that the different integers from the set [m, n] have different likelihoods of being selected. A random integer may be selected by summing a plurality of randomly generated integers, such as summing values resulting from rolling a plurality of dice. As an example, in the variation in which the sequentially indexed game-items are indexed with integers from the set [3, 18], selecting a random integer may include summing values resulting from rolling three six-sided dice, the sum of which may have a value between 3 and 18. It is to be understood that "roll", "dice", and the "rolling of dice" can be physical or virtual. For example, actually rolling three physical dice, randomly selecting three integers from the set [1, 6] and summing those integers, or randomly selecting an integer in accordance with a predetermined distribution function.

In other embodiments, random integers may be selected such that all integers from the set [m, n] have equivalent likelihoods of being selected.

Figure 2B:
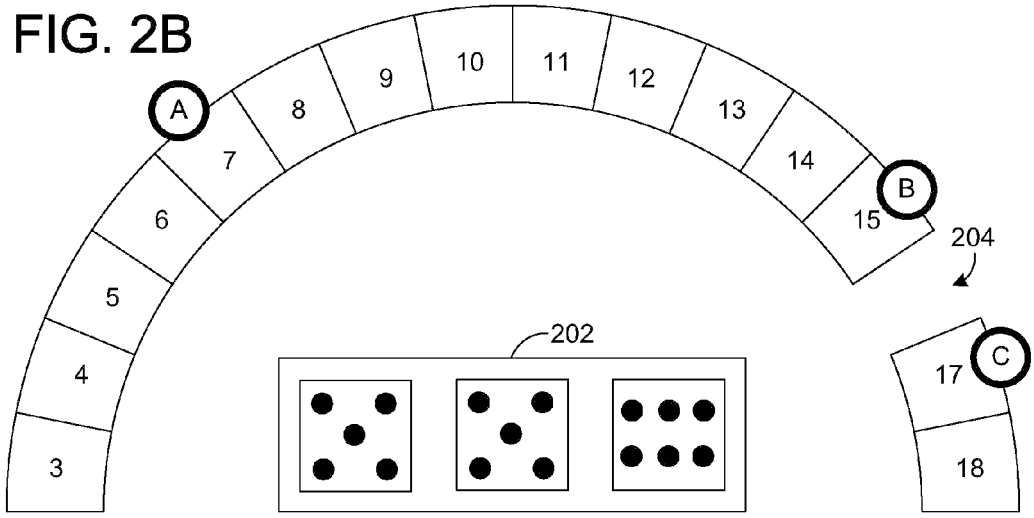

As a nonlimiting example of selecting a random integer r from the set [m, n], FIG. 2B shows a scenario in which r=16 is selected (e.g., rolling a 5-5-6 with three six-sided dice as indicated at 202). According to 110 of method 100 in FIG. 1, it is determined if the game-item having an index r remains in play. Because r=16 and the game-item indexed 16 is still in play, the game-item indexed 16 is removed as indicated at 204 of FIG. 2B and in accordance with 112 of method 100. In this example, game-item 16 is an intermediate game-item and there is no stake on game-item 16 (i.e., game-item 16 is not a target game-item); thus, there are no payouts for the removal of game-item 16 and method 100 of FIG. 1 loops back to 106, where a subsequent phase of the game of chance begins.

Figure 2C:
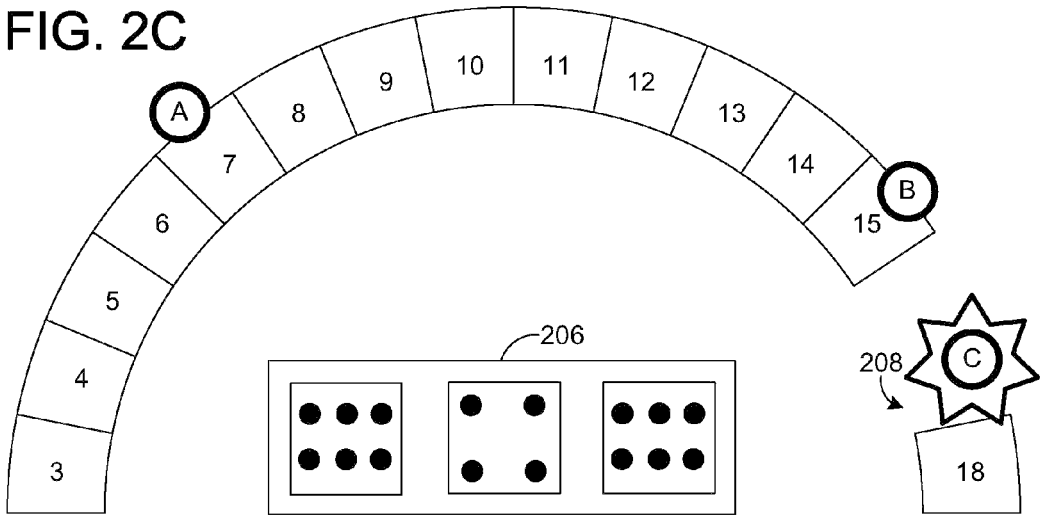

FIG. 2C shows an example of the subsequent phase of the game of chance in which a random integer r=16 is selected again (e.g., rolling a 6-4-6 with three six-sided dice, as indicated at 206). Because the game-item indexed 16 is no longer in play, method 100 of FIG. 1 proceeds to 114, where the median of the set [m, n] is compared to the random integer r. If r is less than the median of the set, the game-item having the highest index less than r is removed from play according to 116 of method 100 or, if r is greater than the median of the set, the game item having the lowest index greater than r is removed from play at 118 of method 100. In this example, the random integer r=16 is greater than the set's median of 10.5, therefore, the remaining game-item having the lowest index greater than 16, game-item 17, is removed from play as shown at 208 in FIG. 2C.

At 120, method 100 includes determining if the game-item removed from play is a target item. Game-item 17, which is removed from play in the example of FIG. 2C, is a target item for player C. As shown in FIG. 1 at 124 of method 100, if a target item is removed from play, the corresponding player is awarded a return and the game of chance ends for the player. The amount of the return is dependent on the base-stake wagered by the player, as described earlier, and may be proportional to the likelihood of the target game-item being removed from play. For example, when rolling three six-sided dice there are 216 possible outcomes. Six of these outcomes may be a combination with a sum of 5, while 25 of the outcomes may be a combination with a sum of 9. It is, therefore, less likely that a sum of 5 will be rolled and a player has a lower chance of winning by placing a stake on 5; hence, the return for a stake on 5 may be greater than the return for a stake wagered on 9.

It is to be understood that in some embodiments additional gambling may continue after a player is awarded a return. For example, another player may continue to use the same board in an attempt to win a return after that player's target item is selected. As another example, one or more players may be allowed to continue to issue side bets until the first and last game items or all key items are removed from the board.

Figure 2D:
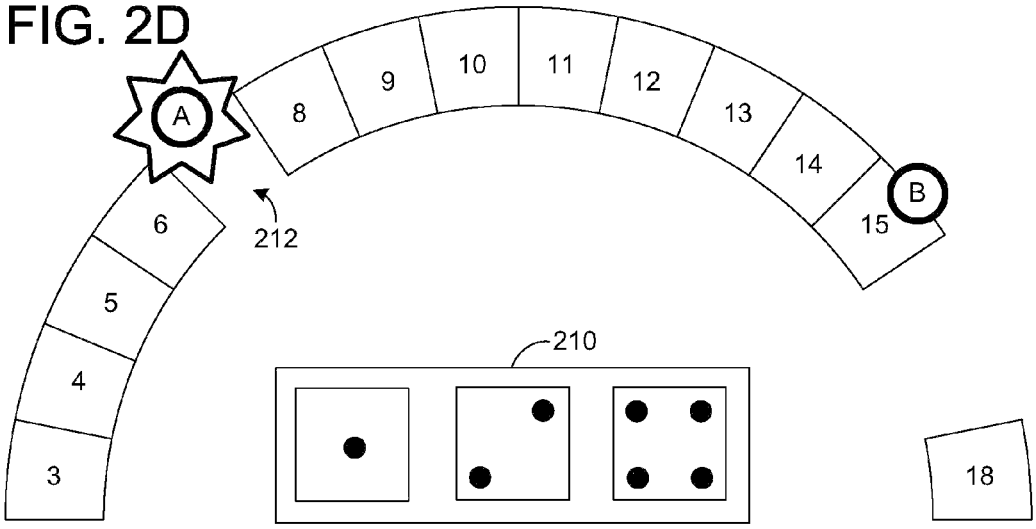

In a subsequent phase shown in FIG. 2D, a random integer r=7 is selected (e.g., rolling a 1-2-4 with three six-sided dice, as indicated at 210) and game-item 7 is removed from play as indicated at 212. Method 100 of FIG. 1 proceeds from 112 to 120, in which it is determined game-item 7 is a target item for player A. Player A is awarded a return, as described above, and the game ends for player A; however, in some embodiments, player A may be allowed to continue placing side bets. Although the game is over for player A and player C, player B remains in the game, so the game of chance moves on to another phase for that player.

Figure 2E:
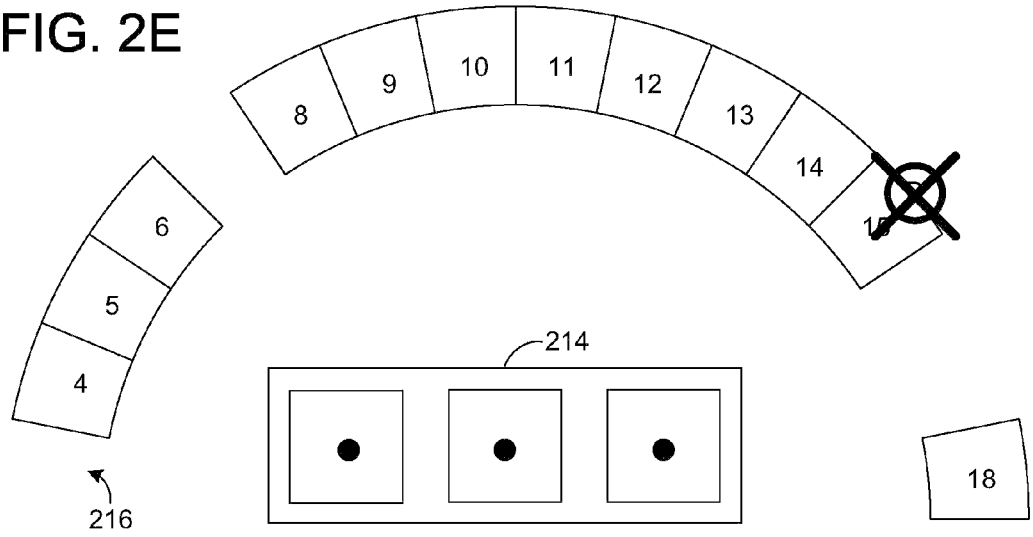

FIG. 2E shows a subsequent phase. In this example, a random integer r=3 is selected (e.g., rolling a 1-1-1 with three six-sided dice as indicated at 214). Consequently, game-item 3 is removed from play as indicated at 216. At 122, method 100 of FIG. 1 includes determining if the first or last game-items are in play. If the first or last game-items are no longer in play, as a result of removal, the game of chance ends for all players remaining in the game and no returns are awarded. Because game-item 3 corresponds to a first game-item, the game ends for player B, the only player remaining in the game. As such, player B is not awarded a return.

In some variations of a game of chance, the game may not end in defeat for all players with the removal of a first or last game-item. In such variations, all players are awarded a return if the random integer r selected in the first phase of the game corresponds to a first or last game-item. As an example, if the random integer r=18 is selected (e.g., rolling a 6-6-6 with three six-sided dice) from the set [3, 18] in the first phase after stakes are received from players, all players are awarded a return and the game of chance ends.

Figure 3A:
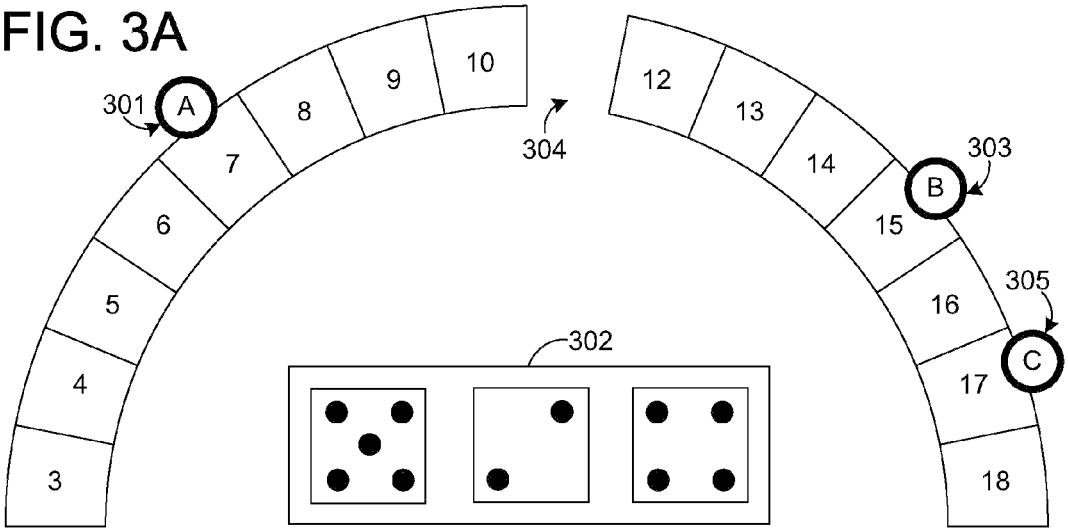
FIGS. 3A-3B show another example sequence of phases of a game of chance.

The arrangement of the first phase of another game of chance is shown in FIG. 3A. In this embodiment, game-item 10 and game-item 11 serve as the key game-items. As before, there are three players with stakes on three target game-items. In particular, as shown at 301, player A has a stake on game-item 7; as shown at 303, player B has a stake on game-item 15; and as shown at 305, player C has a stake on game-item 17. A random integer r=11 is chosen (e.g., rolling a 5-2-4 with three six-sided dice as indicated at 302) in the first phase. FIG. 3A shows the removal of game-item 11 at 304 corresponding to the selection of r=11. It should be noted that game-item 11 is a key game-item. At 122 of method 100 shown in FIG. 1, it is determined if any key items remain in play. If there are no key items remaining, the game of chance ends for all players. Because one key item (i.e., game-item 10) remains in play, method 100 loops back to 106, where a subsequent phase of the game begins.

Figure 3B:
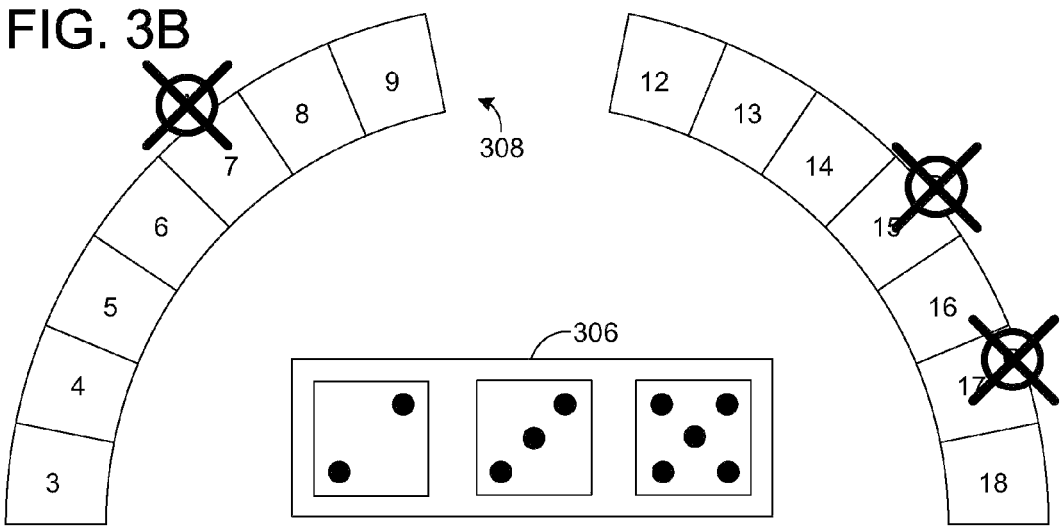

FIG. 3B shows a subsequent phase, in which the random number r=10 is selected (e.g., rolling a 2-3-5 with three six-sided dice as indicated at 306). Game-item 10, which is one of two key game-items in the set [3, 18], is removed from play. At 122 of method 100 of FIG. 1, it is determined that no key items remain in play and the game of chance ends for all players. In this example, the game ends before any players are awarded a return.

In some variations of a game of chance, one or more side-stakes may be received from players in addition to a base-stake. In such variations, side-stakes may take the same form as the base-stake (e.g., cash or cash equivalent, virtual dollars or points, etc.). A side-stake may be received prior to any phase of the game of chance. For example, a side-stake may be received at the same time as a base-stake or a side-stake may be received prior to any subsequent phase of the game. In some embodiments, a side-stake may even be received from a defeated player.

Figure 4A:
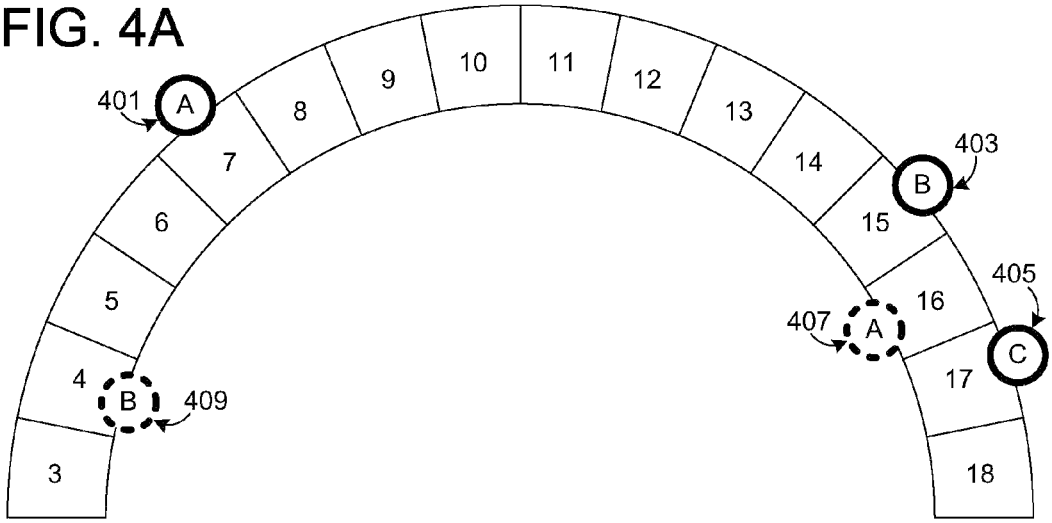
FIGS. 4A-4C show another example sequence of phases of a game of chance.

FIG. 4A shows an example of a game of chance in which side-stakes are received. In this example, base-stakes are received from three players. In particular, as shown at 401, player A has a stake on game-item 7; as shown at 403, player B has a stake on game-item 15; and as shown at 405, player C has a stake on game-item 17. In addition, side-stakes are received from two of the three players. In particular, as shown at 407, player A has a side-stake on game-item 16; and as shown at 409, player B has a side-stake on game-item 4. The side-stakes in this example correspond to individual game-items (e.g., game-item 16 and game-item 4); however, side-stakes are not limited to individual game-items. As an example, a side-stake may correspond to a subset of game-items (e.g., [4, 9] or [12, 17]). In some embodiments, a side-stake may correspond to the combination of numbers rolled with a plurality of dice. For example, rolling three six-sided dice may result in a "run" (i.e., any three numbers in sequence, such as 2-3-4), a "pair" (i.e., any two matching, such as 2-2-6), or a "triple" (i.e., all three numbers matching, such as 5-5-5).

Figure 4B:
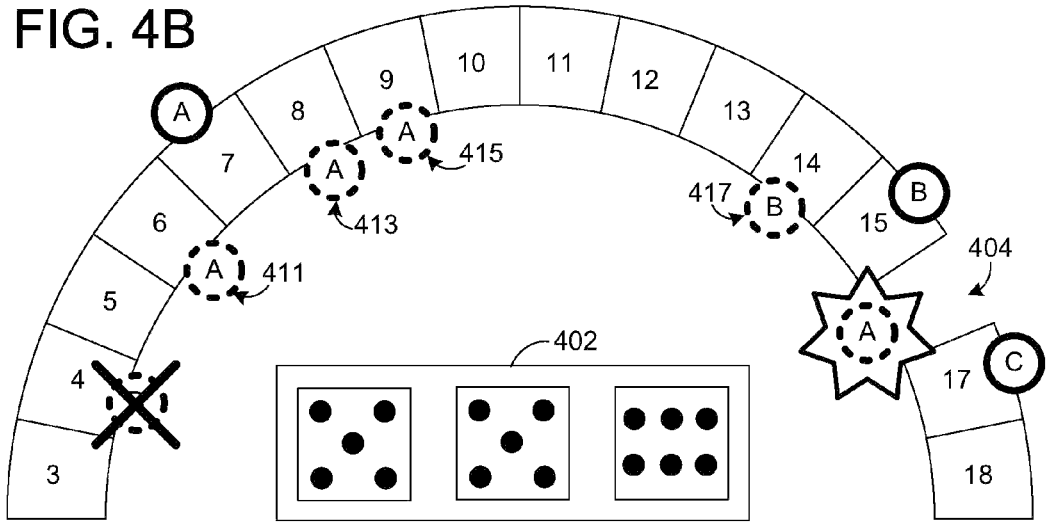

A first phase of the game is shown in FIG. 4B. A random integer r=16 is selected (e.g., rolling a 5-5-6 with three six-sided dice as indicated at 402) and game-item 16 is removed as a result at 404. Game-item 16 corresponds to a side-stake from player A, and thus player A is awarded a return. As described above, the amount of the return may be dependent on the side-stake wagered by the player and may be proportional to the likelihood of the target game-item being removed from play. For example, a side-stake on a run may have a higher return than a side-stake on a pair, as it is less likely to roll a run than a pair.

In the example of FIG. 4B, the side-stake on game-item 4 does not correspond to the selected random integer r=16; thus, it is removed and no return is awarded to player B. Prior to the beginning of the next phase, new side-stakes are received from players. In particular, as shown at 411, player A has a side-stake on game-item 6; as shown at 413, player A has a side-stake on game-item 8; as shown at 415, player A has a side-stake on game item 9; and as shown at 417, player B has a side-stake on game item 14.

Figure 4C:
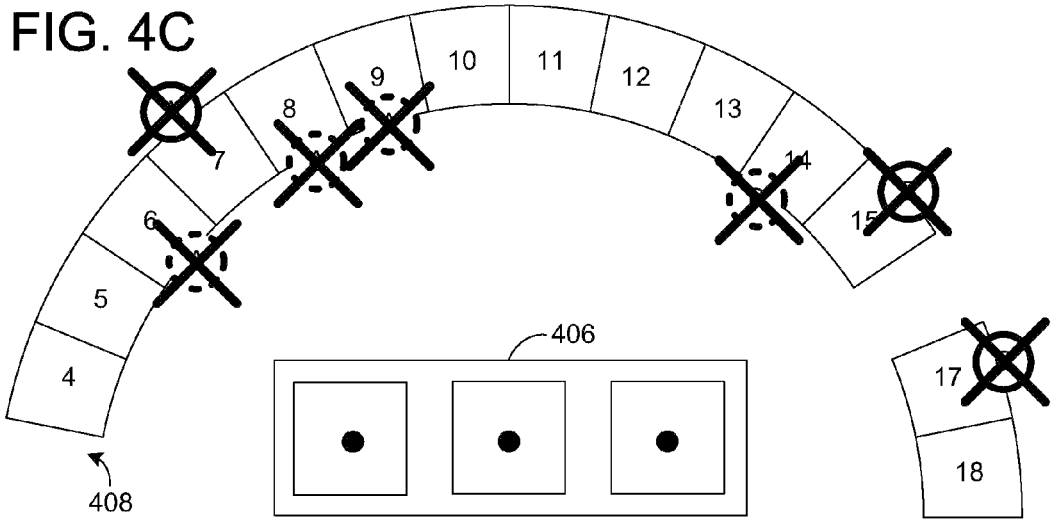

FIG. 4C shows a subsequent phase of the game. In this example, a random integer r=3 is selected (e.g., rolling 1-1-1 with three six-sided dice as indicated at 406), which corresponds to the first game-item. As a result, game-item 3 is removed from play. According to 122 of method 100 shown in FIG. 1, if a first or last game-item is removed from play, the game of chance ends for all players. Thus, all players are defeated and the game ends, and because no side-stakes hit, no returns are paid for the side-stakes.

Figure 5:
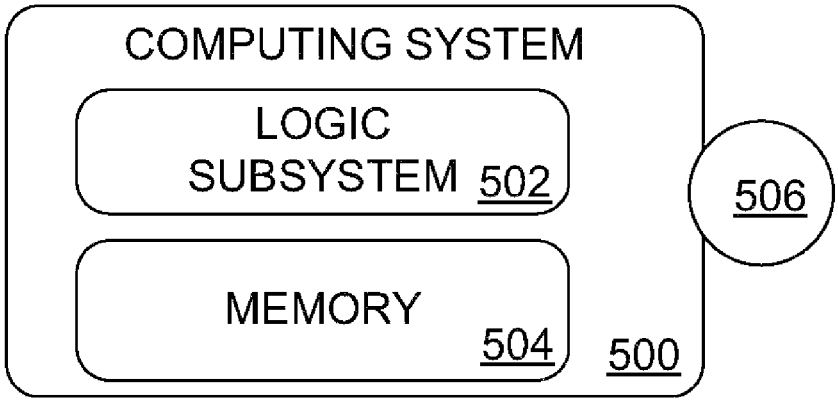
FIG. 5 schematically shows a computing system 500 that may host a game of chance.

In some embodiments, a game of chance in accordance with the present disclosure may be hosted by a variety of different computing devices. FIG. 5 schematically shows a computing system 500 that may host a game of chance. Computing system 500 includes a logic subsystem 502 and memory 504.

Logic subsystem 502 may include one or more physical devices configured to execute one or more instructions. For example, the logic subsystem may be configured to execute one or more instructions that are part of one or more programs, routines, objects, components, data structures, or other logical constructs. Such instructions may be implemented to perform a task, implement a data type, change the state of one or more devices, or otherwise arrive at a desired result. The logic subsystem may include one or more processors that are configured to execute software instructions. Additionally or alternatively, the logic subsystem may include one or more hardware or firmware logic machines configured to execute hardware or firmware instructions. The logic subsystem may optionally include individual components that are distributed throughout two or more devices, which may be remotely located in some embodiments.

Memory 504 may include one or more physical devices configured to hold data and/or instructions that, when executed by the logic subsystem, cause the logic subsystem to implement the herein described methods and processes. Memory 504 may include removable media and/or built-in devices. Memory 504 may include optical memory devices, semiconductor memory devices, and/or magnetic memory devices, among others. Memory 504 may include portions with one or more of the following characteristics: volatile, nonvolatile, dynamic, static, read/write, read-only, random access, sequential access, location addressable, file addressable, and content addressable. In some embodiments, logic subsystem 502 and memory 504 may be integrated into one or more common devices and/or computing systems.

FIG. 5 also shows memory in the form of removable media 506, which may be used to store and/or transfer instructions that, when executed, perform the herein described methods and processes.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A method of hosting a game of chance, the method comprising:

putting into play via a game-playing computing device a plurality of game-items sequentially indexed with integers from a set [3, 18], the plurality of game-items including a first game-item indexed 3, a last game-item indexed 18, and a set of key game-items including a key game-item indexed 10 and a key game-item indexed 11;

receiving from a player via the game-playing computing device a stake corresponding to a target game-item; and beginning a phase of the game of chance via the game-playing computing device, the phase comprising:

selecting a random integer r from the set [3, 18] by rolling three six-sided dice;

if a game-item having an index r remains in play, removing that game-item from play;

if a game-item having an index r is not in play, removing from play a remaining game-item having a highest index less than r if r is less than 10.5, or removing from play a remaining game-item having a lowest index greater than r if r is greater than 10.5; and if the target game-item is removed from play, awarding the player a return and ending the game of chance; else if either the first game-item or the last game-item is removed from play or all key game-items are removed from play, ending the game of chance; else if both the first game-item and the last game-item remain in play and any key game-item remains in play, beginning a subsequent phase of the game of chance via the game-playing computing device.

2. The method of claim 1, where the return awarded to the player is set proportional to a likelihood of the target game-item being removed from play.

3. A method of hosting a game of chance, the method comprising:

putting into play via a game-playing computing device a plurality of game-items sequentially indexed with integers from a set [m, n], the plurality of game-items including a first game-item indexed m, a last game-item indexed n, and a set of key game-items equally spaced from the first game-item and the last game-item;

receiving from a player via the game-playing computing device a stake corresponding to a target game-item; and beginning a phase of the game of chance via the game-playing computing device, the phase comprising:

selecting a random integer r from the set [m, n];

if a game-item having an index r remains in play, removing that game-item from play;

if a game-item having an index r is not in play, removing from play a remaining game-item having a highest index less than r if r is less than a median of the set [m, n], or removing from play a remaining game-item having a lowest index greater than r if r is greater than the median of the set [m, n]; and if the target game-item is removed from play, awarding the player a return and ending the game of chance; else if either the first game-item or the last game-item is removed from play or all key game-items are removed from play, ending the game of chance; else if both the first game-item and the last game-item remain in play and any key game-item remains in play, beginning a subsequent phase of the game of chance via the game-playing computing device.

4. The method of claim 3, where the plurality of game items further includes a first set of one or more intermediate game-items sequentially between the first game-item and the set of key game-items and a second set of one or more intermediate game-items sequentially between the set of key game-items and the last game-item, the first set of intermediate game-items and the second set of intermediate game-items being a same size.

5. The method of claim 3, where the plurality of game-items is an even number of game-items.

6. The method of claim 5, where the set of key game-items is two key game-items.

7. The method of claim 3, where the plurality of game-items is an odd number of game-items.

8. The method of claim 7, where the set of key game-items is one game-item.

9. The method of claim 3, where one or more phases further comprises receiving from a player a side-stake corresponding to a target integer from the set [m, n] and awarding the player a side-return if r is the target integer.

10. The method of claim 3, where random integers are selected such that different integers from the set [m, n] have different likelihoods of being selected.

11. The method of claim 10, where selecting a random integer from the set [m, n] includes summing a plurality of randomly generated integers.

12. The method of claim 11, where summing a plurality of randomly generated integers includes summing values from a plurality of dice.

13. The method of claim 3, where random integers are selected such that all integers from the set [m, n] have equivalent likelihoods of being selected.

14. The method of claim 3, where the set [m, n] is a set [3, 18].

15. The method of claim 14, where selecting a random integer includes summing values from three six-sided dice.

16. The method of claim 15, where one or more phases further comprises receiving from a player a side-stake corresponding to a specific combination of dice values and awarding the player a return if the specific combination of dice values is rolled.

17. The method of claim 3, where the return awarded to the player is set proportional to a likelihood of the target game-item being removed from play.

18. The method of claim 3, where a return is awarded to the player if the first game-item or the last game-item is removed during a first phase of the game of chance.

19. The method of claim 3, where the player is one of a plurality of players and a stake corresponding to a target game-item is received from each of the plurality of players and a return is awarded to a player if the target game-item is removed from play for that player.

20. A physical memory device holding instructions executable by a logic subsystem to:

put into play a plurality of game-items sequentially indexed with integers from a set [m, n], the plurality of game-items including a first game-item indexed m, a last game-item indexed n, and a set of key game-items equally spaced from the first game-item and the last game-item;

receive from a player a stake corresponding to a target game-item; and begin a phase of a game of chance, the phase comprising:

selecting a random integer r from the set [m, n];

if a game-item having an index r remains in play, removing that game-item from play;

if a game-item having an index r is not in play, removing from play a remaining game-item having a highest index less than r if r is less than a median of the set [m, n], or removing from play a remaining game-item having a lowest index greater than r if r is greater than the median of the set [m, n]; and if the target game-item is removed from play, awarding the player a return and ending the game of chance; else if either the first game-item or the last game-item is removed from play or all key game-items are removed from play, ending the game of chance; else if both the first game-item and the last game-item remain in play and any key game-item remains in play, beginning a subsequent phase of the game of chance.

* * * * *